United States Patent [19]

Wahl

[11] 3,981,639

[45]*Sept. 21, 1976

[54] NUTATING ENGINE

[76] Inventor: Robert H. Wahl, 1747 Creek Road, Rochester, N.Y. 14625

[ * ] Notice: The portion of the term of this patent subsequent to July 29, 1992, has been disclaimed.

[22] Filed: Sept. 24, 1974

[21] Appl. No.: 508,744

[52] U.S. Cl. ..... 418/49
[51] Int. Cl.[2] ..... F04C 1/00
[58] Field of Search ..... 418/44, 50, 51, 52, 418/68

[56] References Cited

UNITED STATES PATENTS

| | | | |
|---|---|---|---|
| 2,016,605 | 10/1935 | Kempthorne | 418/68 |
| 3,156,222 | 11/1964 | Miller | 418/68 X |
| 3,464,361 | 9/1969 | Voser | 418/68 |
| 3,485,218 | 12/1969 | Clarke | 123/8.45 X |
| 3,492,974 | 2/1970 | Kreimeyer | 418/68 X |
| 3,895,610 | 7/1975 | Wahl | 123/8.45 |

*Primary Examiner*—Carlton R. Croyle
*Assistant Examiner*—Michael Koczo, Jr.
*Attorney, Agent, or Firm*—Shlesinger, Fitzsimmons & Shlesinger

[57] ABSTRACT

A rotor having the configuration of a spherical wedge is mounted in a hemispherically shaped chamber for rotary, nutating motion about the center of curvature of the chamber. The rotor divides the chamber into two separate sections, and revolves about a stub shaft carried on the inner end of a crankshaft, which projects into the chamber at an angle of approximately 18° to the stub shaft. An apex formed by a pair of intersecting, plane surfaces on the rotor, is maintained in sliding engagement with the flat, base end of the hemispherical chamber. During each half revolution the rotor pivots about its apex to swing its intersecting, plane surfaces alternately into contiguous relation to the flat end of the chamber so that the two separate sections thereof are alternately compressed and expanded. Necessary ports are provided for supplying fluid to, and exhausting fluid from, said chamber sections.

7 Claims, 4 Drawing Figures

NUTATING ENGINE

This invention relates to nutating devices, and more particularly to an improved rotary nutating engine operable selectively as a motor or pump.

In my copending U.S. Pat. application Ser. No. 470,860, filed May 17, 1974, and now U.S. Pat. No. 3,895,610, I have disclosed a novel nutating engine comprising a housing containing a stator and a segmental-spherical rotor. The rotor is mounted in a spherical chamber in the housing for rotary nutating motion about the face of the stator. In its face the rotor has three equi-angularly spaced scallops or recesses, which are separated by three equi-angularly spaced ribs or apices, which project radially from the center of the rotor face. The stator has in its face only two opposed recesses or scallops, which are separated by a pair of registering, radial ribs or apices, which form a straight line diametrally across the face of the stator. The rotor is rotatable on the inner end of a crankshaft, which projects into the chamber coaxially of the stator.

In use, the rotor rotates on the crankshaft about an axis inclined to the axis of the crankshaft, and at a rate equivalent to one-third of a revolution of the rotor for every complete revolution of the crankshaft. The three recesses in the face of the rotor are thus subjected to successive compression and expansion operations as the rotor apices pass those of the stator.

It has now been discovered that it is not necessary in all cases to employ a plurality of recesses on the confronting surfaces of both the stator and rotor in an engine of the type described. This results in a material reduction in the cost of the engine, and also increases its efficiency.

It is an object of this invention, therefore, to provide an improved rotary nutating engine which is substantially less expensive and easier to construct then prior such engines.

Still another object of this invention is to provide an improved rotary nutating engine in which at least one of its two principal operating members, either the rotor or the stator, has a plane surface about which the other operating member is mounted for rotary nutating motion.

Other objects of this invention will be apparent hereinafter from the specification and from the recital of the appended claims, particularly when read in conjunction with the accompanying drawings.

Figure 1:
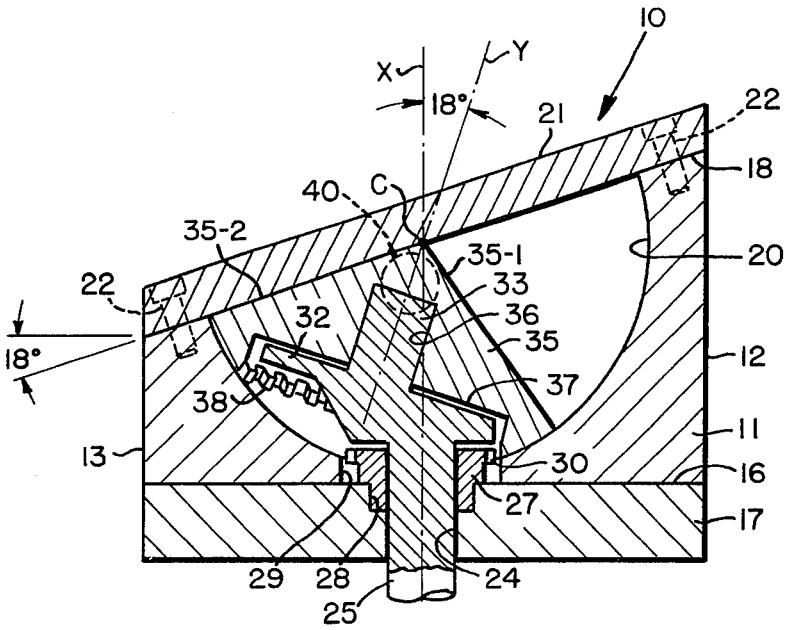
FIG. 1 is a sectional view taken on a vertical plane through the center of a rotary nutating engine made according to one embodiment of this invention.

Referring now to the drawings by numerals of reference, 10 denotes generally an engine comprising a housing 11 having parallel end surfaces 12 and 13 (FIGS. 1 to 3), parallel side surfaces 14 and 15 (FIG. 3), which extend at right angles to surfaces 12 and 13, and a plane bottom surface 16. Surface 16 lies in a plane normal to the housing surfaces 12 to 15, and has secured thereover a rectangular bottom plate 17. The upper surface 18 of the housing lies in a plane that extends normal to the side surfaces 14 and 15, and which is inclined downwardly from the rear surface 12 toward the front surface 13 of the housing at an angle of approximately 18° to the horizontal.

Housing 11 has therein a large, central, hemispherical recess 20, which opens at its diametral end on the upper surface 18 of the housing so that the center C of the recess 20 lies in the plane of surface 18. Recess 20 is covered by a removable plate or stator 21, which is secured by bolts 22 to the housing against the surface 18.

Mounted to rotate in a central opening 24 in the bottom plate 17 is a crankshaft 25, which has an axis of rotation X that extends through the center C of recess, 20 and at right angles to plate 17. Shaft 25 projects rotatably through the bore in an annular phasing gear 27, which is fixed in a counterbore 28 in plate 17, and which extends through a central opening 29 in the bottom of housing 11 so that its teeth 30 project into the recess 20 coaxially of axis X.

Above the gear 27 shaft 25 has thereon a transverse shoulder or head portion 32, which lies in a plane inclined to the crankshaft axis X. Projecting coaxially upwardly from portion 32 is a cylindrical stub shaft 33, which has an axis Y that extends through the center C of recess 20, and which, in the illustrated embodiment, is inclined at approximately 18° to the crankshaft axis X.

Mounted to rotate in recess 20 beneath plate 21 is a rotor 35, which has the configuration of a spherical wedge that corresponds to a section of the sphere represented, in part, by the chamber 20. Stub shaft 33 and the head portion 32 of crankshaft 25 projects rotatably into a circular recess 36 and its counterbore 37, respectively, which are formed in the curved surface of the rotor 35 centrally thereof. A plurality of gear teeth 38 are formed in the rotor 35 around the outer end of its counterbore 37 to mesh with the teeth 30 on the stationary gear 27. The rotor 35 is thus capable of rotating coaxially about the axis Y of stub shaft 33, and is also mounted for rotational and nutating motion by or with the crankshaft 25 about the axis X.

Whenever the crankshaft 25 is rotated, the rotor 35 revolves within recess 20; and conversely, whenever the rotor 35 revolves in housing 11, the crankshaft 25 is rotated. There are twice the number of gear teeth 38 on the rotor 35 as there are on the phasing gear 27, so that the rotor 35 is made to revolve at one-half the speed of shaft 25. This means that the rotor 35 makes one complete revolution in recess 20 for each two revolutions of the crankshaft 25. This relative motion between the rotor 35 and the shaft 25 imparts nutating rotary motion to the rotor, and enables its apex 35A to be maintained sealingly in contact with the underside of the plate 21. Moreover, each time the rotor revolves 180° it is swung or pivoted about its apex 35A so that its intersecting plane surfaces 35-1 and 35-2 alternately are brought into near engagement with the underside of plate 21. Thus recess 20 is divided into two revolving chambers separated by the apex 35A. These chambers are bound by the stator 21 and by the respective surfaces 35-1 and 35-2; and they are alternately expanded and contracted.

Figure 2:
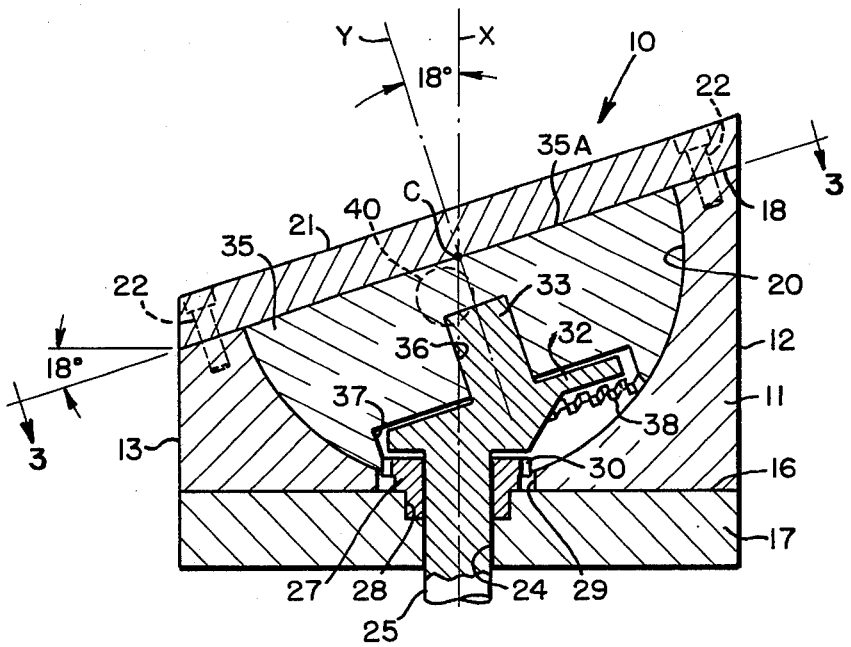
FIG. 2 is a sectional view similar to FIG. 1 but showing the rotor and crankshaft of this engine rotated 90° and 180°, respectively, from their positions as shown in FIG. 1.
Figure 3:
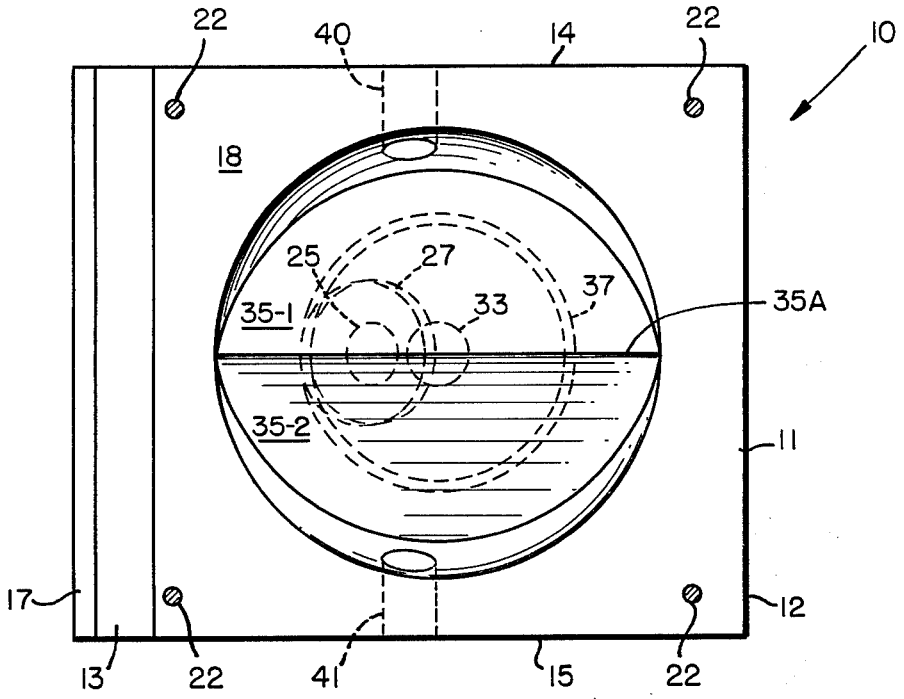
FIG. 3 is a sectional view taken along the line 3—3 in FIG. 2 looking in the direction of the arrows.
Figure 4:
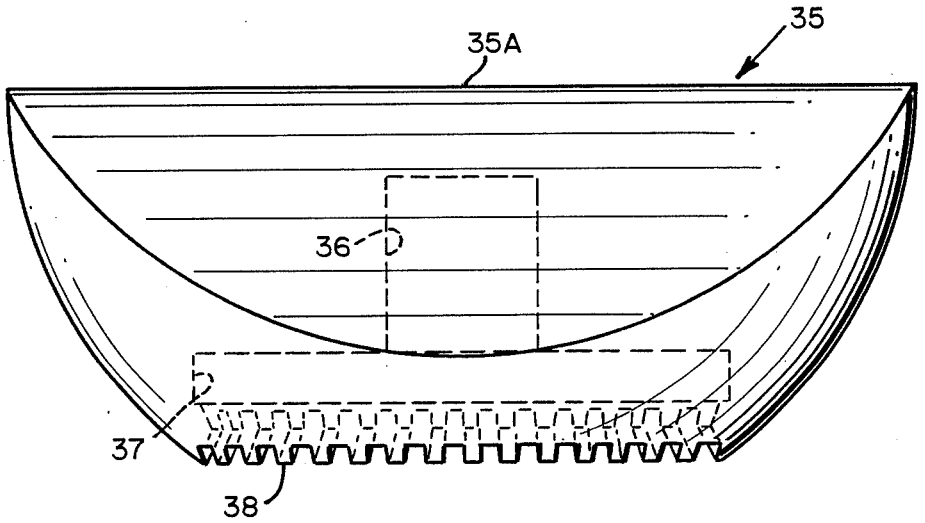
FIG. 4 is an enlarged side elevational view of the rotor employed in this engine.

For example, as illustrated in FIG. 1, the chamber corresponding to portion of recess 20 bound by plate 21 and by the surface 35-2 of the rotor is at a minimum, while the chamber corresponding to the portion of the recess 20 bound by plate 21 and the rotor surface 35-1 is at a maximum. When the shaft 25 has been rotated 180° from its position as shown in FIG. 1 to its position as illustrated in FIGS. 2 and 3, the rotor 35 will have been rotated 90° from its position in FIG. 1, or into its so-called mid position, as shown in FIGS. 2 and 3. In this mid position the rotor 35 uncovers the inner ends of two ports 40 and 41, which extend through the opposite side walls of the housing 11 from its side surfaces 14 and 15, respectively, and which are covered by the rotor when in its position shown in FIG. 1. When the shaft 25 revolves still another 180°, the rotor 35 rotates another 90° until it assumes a position similar to that shown in FIG. 1, except that the rotor surface 35-1 is now disposed adjacent to the underside of plate 21 at the left end thereof as illustrated in FIG. 1, while the rotor surface 35-2 will now be located in the position formerly occupied by surface 35-1. During this last 90° rotation of the rotor 35 the inner ends of the ports 40 and 41 are gradually closed by the rotor, becoming fully closed when the rotor has revolved 180° from its position as shown in FIG. 1.

When the shaft 25 has revolved 720°, the rotor 35 will have completed one revolution, and will have returned to the position illustrated in FIG. 1.

Operating as a fluid pump, and with the rotor 35 being turned by shaft 25, for example clockwise as viewed in FIG. 3 from a starting position as shown in FIG. 1, the rotor begins to uncover the inner ends of the ports 40 and 41 at the same time that the surface 35-2 begins to tilt or swing away from the underside of the plate 21. At this time the rotor surface 35-1 also, of course, begins to swing or pivot upwardly toward the underside of plate 21. During this movement fluid is drawn through port 40 into the expanding portion of the chamber located between plate 21 and the revolving rotor surface 35-2, while the other chamber, or the portion of the recess 20 located between plate 21 and the rotor surface 35-1, is correspondingly reduced so that the fluid therein is compressed or pumped out of the port 41 as the rotor completes 180° of revolution from its position illustrated in FIG. 1. When the rotor has revolved 180° the ports 40 and 41 again will be closed by the opposite ends of the rotor, and the rotor surface 35-1 will now be disposed in the position formerly occupied by surface 35-2.

As the externally driven crankshaft 25 continues to rotate another 180° in a clockwise direction (FIG. 3), the rotor continues to revolve so that the ports 40 and 41 are once again uncovered while the rotor surface 35-1 begins to tilt or swing away from the underside of the plate 21, at the same time that the surface 35-2 begins to swing back toward the underside of the plate 21 on a compression stroke. During this other one half revolution of the rotor 35 fluid is again drawn through the port 40 into the chamber bound by the revolving rotor surface 35-1 and the cover plate 21, at the same time that the fluid, which was previously drawn into the other chamber by surface 35-2, is now compressed and forced out of the port 41 as the rotor surface 35-2 revolves back to its starting position as shown in FIG. 1.

When the unit is operated as a fluid motor, rotation of the rotor 35 is started (for example clockwise in FIG. 3) initially by an external source. As soon as the revolving rotor uncovers the inner end of port 40, fluid entering this port under pressure will force the chamber between surface 35-2 and the stator 21 to expand, thereby causing the rotor to continue to turn clockwise approximately 180°, while the other chamber, between the rotor surface 35-1 and the stator, contracts to force fluid out of the port 41. With the illustrated porting, the inertia of the rotor 35, which may be augmented by, for example, a fly wheel (not illustrated) attached to the shaft 25, causes the rotor to continue to revolve beyond 180° from its initial position, at which time the rotor surface 35-1 will begin to swing away from the underside of the stator 21, and the fluid under pressure entering the port 40 will exert pressure against the rotor surface 35-1 causing the rotor to continue to revolve in a clockwise direction. During this subsequent 180° revolution of the rotor, of course, the rotor surface 35-2 commences to swing back toward the stator 21, thus compressing any fluid in the corresponding chamber and forcing it out of the port 41. As long as fluid under pressure is applied through the port 40 the rotor 35 will continue to rotate, therefore driving the crankshaft 25 at a speed twice that of the rotor.

From the foregoing it will be apparent that the instant invention provides an extremely compact and reliable device capable of functioning selectively as a pump and as a motor. For any application it will be apparent to one skilled in the art that the ports 40 and 41 can be placed in locations different from those illustrated. For example, the ports may be located in the rotor, the stator or the housing. Moreover, the device may be operated as a four-cycle engine having an intake valve and an exhaust valve located in the vicinity of ports 40 and 41, respectively, and a sparkplug located intermediate the valves. As a two-cycle engine intake and exhaust ports could be located adjacent the lower right hand side of recess 20 as shown in FIG. 1 and would be effective if suitable supercharging is provided. It is also possible to have one portion of recess 20, say between surface 35-2 and stator 21, used to pump fuel into the other chamber between 31-1 and the stator at the proper moment for two-cycle operation of the last-named chamber as an internal combustion engine. It will be apparent also that the inclination of the axis of shaft 33 to shaft 25 may be other than 18°, which was used herein merely for purposes of illustration.

While only certain embodiments of the invention have been illustrated and described herein, it will be apparent that the application is intended to cover any such modifications of the invention which may fall within the scope of one skilled in the art and the appended claims.

Having thus described my invention, what I claim is:

1. An engine, comprising a housing having therein a hemispherical chamber bound in part by a first, plane surface disposed diametrally of the sphere of which said chamber is a segment, a rotor in said chamber having the configuration of a spherical wedge, and having a pair of intersecting, surfaces forming an apex extending diametrally across said chamber and in sliding engagement with said first surface, a shaft projecting at one end part way into said chamber and rotatable about a first axis inclined to said first surface and extending through a point common to the centers of said first surface and said sphere, and means mounting said rotor on said one end of said shaft for rotation relative thereto about a second axis inclined to said first axis and extending through said point coaxially of said rotor, said mounting means including phasing means for effecting one half revolution of said rotor about said point for each revolution of said shaft, thereby to pivot said rotor in opposite directions about its apex during each revolution of said rotor, whereby said intersecting surfaces on said rotor are alternately swung toward and away from said first surface to effect compression and expansion, respectively, of the corresponding portions of said chamber.

2. An engine as defined in claim 1, wherein said mounting means comprises a stub shaft projecting from the first-named shaft rotatably and coaxially into a bore formed in the curved surface of said rotor centrally thereof, and operatively supporting said rotor on the inner end of said first-named shaft for rotation about said second axis, a phasing gear fixed in said chamber, and a plurality of gear teeth formed on said rotor and drivingly engaged with the teeth of said phasing gear to effect said relative rotation between said rotor and said first-named shaft.

3. An engine as defined in claim 1, wherein said pair of surfaces on said rotor are surfaces intersecting at an included angle of less than 180°, one of said surfaces on said rotor is swung into contiguous relation with one half of said first surface when said rotor has revolved 180° from a first position, and the other of said surfaces is swung into contiguous relation with said one half of said first surface when said rotor has revolved 360° from said first position, and said housing has therein a pair of ports opening on said chamber adjacent opposite sides thereof, and disposed to be closed by said rotor when the latter is in said first position, and to be uncovered by said rotor to communicate with two separate portions of said chamber when said rotor is 90° from said first position.

4. An engine as defined in claim 3, wherein said two portions of said chamber are separated by said apex of said rotor and alternately are expanded and contracted during rotation of said rotor.

5. An engine as defined in claim 1, wherein said first and second axes are inclined approximately 18° to each other.

6. An engine, comprising a housing containing a hemispherical chamber, a rotor mounted to revolve in said chamber and having the configuration of a spherical wedge the curved surface of which has the same center and radius as the curved end of the chamber, said rotor having a pair of plane surfaces which intersect to form on the rotor an apex which has sliding engagement with the plane end of said chamber, a rotatable shaft projecting into said chamber, and means connecting said rotor to said shaft and operative during each revolution of said rotor to impart nutating motion thereto, whereby during each revolution of the rotor first one and then the other of said plane surfaces thereon are swung on compression strokes toward said plane end of said chamber, while said other and said one surface thereon, respectively, are swung on expansion strokes away from said plane end of said chamber, said housing having therein at least two ports for supplying fluid to one portion of said chamber while exhausting fluid from another portion thereof during each half revolution of said rotor, and said connecting means including means mounting said rotor on said shaft for rotation relative thereto about a first axis inclined to the axis of said shaft, and extending through the common center of the curved surfaces of said rotor and said chamber.

7. An engine as defined in claim 6, wherein said connecting means further includes means for rotating said rotor one half revolution about said first axis each time said shaft rotates one revolution about its axis.

* * * * *